US007740145B2

(12) United States Patent
Chung

(10) Patent No.: US 7,740,145 B2
(45) Date of Patent: Jun. 22, 2010

(54) BOTTLE CAP

(76) Inventor: Hyun-Soo Chung, 9-906 Kyoung-nam Apartment, 649 Gapo-Dong, Kangnam-Gu, 135-240 Seoul (KR)

( * ) Notice: Subject to any disclaimer, the term of this patent is extended or adjusted under 35 U.S.C. 154(b) by 1364 days.

(21) Appl. No.: 10/540,566

(22) PCT Filed: Dec. 23, 2003

(86) PCT No.: PCT/KR03/28050

§ 371 (c)(1),
(2), (4) Date: Jul. 27, 2005

(87) PCT Pub. No.: WO2004/058587

PCT Pub. Date: Jul. 15, 2004

(65) Prior Publication Data

US 2006/0076307 A1 Apr. 13, 2006

(30) Foreign Application Priority Data

Dec. 26, 2002 (KR) ..... 10-2002-0084138

(51) Int. Cl.
*B65D 39/12* (2006.01)

(52) U.S. Cl. ..... 215/360; 138/90; 215/14; 215/21; 215/294; 215/312; 215/313; 220/203.04; 220/203.07; 220/233; 220/235; 220/260

(58) Field of Classification Search ..... 138/90; 215/14, 21, 294, 312, 313, 360; 220/203.04, 220/203.07, 233, 235, 236, 237, 260, 262, 220/290

See application file for complete search history.

(56) References Cited

U.S. PATENT DOCUMENTS 4,961,449 A 10/1990 Demeautis et al.

FOREIGN PATENT DOCUMENTS

| | | |
|---|---|---|
| KR | 20-0143558 | 6/1999 |
| WO | 91/06019 | 4/1992 |

OTHER PUBLICATIONS

International Search Report for PCT/KR2003/002805.

*Primary Examiner*—Anthony Stashick
*Assistant Examiner*—Elizabeth Volz
(74) *Attorney, Agent, or Firm*—Andrew M. Calderon; Roberts Mlotkowski Safran & Cole, P.C.

(57) ABSTRACT

A bottle cap is disclosed, which displays an opened state and cannot contain contents again once it is opened. The bottle cap includes a cap having a screw formed on its inner surface to be engaged with a screw formed on an outer surface of a nozzle of a bottle, a reverse moving means connected to the cap and ascending in a direction opposite to a descending direction of the cap as the cap is rotated downwardly, a rod shaped nut having a screw engaged with the reverse moving means and moving up and down in a screw direction without rotation, and a display installed in the lower portion of the nut, displaying an opened state of the cap by hanging a part of the cap in the nozzle as the cap is moved downwardly by being pushed by the nut if the cap is opened.

13 Claims, 6 Drawing Sheets

BOTTLE CAP

TECHNICAL FIELD

The present invention relates to a bottle cap, and more particularly, to a bottle cap that displays an opened state and cannot contain contents again once it is opened.

BACKGROUND ART

Generally, there are different kinds of products that contain contents such as liquid. The most general product is completed by sealing a bottle with a bottle cap after containing contents in the bottle. The bottle is of glass, plastic and metal.

Such a bottle product includes a bottle and a bottle cap. There are different kinds of bottle caps. That is, there is a simple bottle cap that can be opened using an opener. There is another bottle cap that can be opened by turning the cap through a screw. In this case, the screw is formed on an outer surface of a bottle nozzle and is engaged with a screw formed in the bottle.

The products based on the above bottle caps do not have any special problems in case that they contain cheap contents. However, in case that they contain expensive contents, problems are likely to occur. That is, the expensive contents may be exchanged with the cheap contents.

To prevent such a problem, various methods for sealing a bottle cap are being contrived but there is no method for solving the problem at present.

DISCLOSURE OF THE INVENTION

Accordingly, the present invention is directed to a bottle cap that substantially obviates one or more of the problems due to limitations and disadvantages of the related art.

An object of the present invention is to provide a bottle cap that displays an opened state and cannot contain contents again once it is opened.

Additional features and advantages of the invention will be set forth in the description which follows, and in part will be apparent from the description, or may be learned by practice of the invention. The objectives and other advantages of the invention will be realized and attained by the structure particularly pointed out in the written description and claims thereof as well as the appended drawings.

To achieve these and other advantages and in accordance with the purpose of the present invention, as embodied and broadly described, a bottle cap includes a cap having a screw formed on its inner surface to be engaged with a screw formed on an outer surface of a nozzle of a bottle, a reverse moving means connected to the cap and ascending in a direction opposite to a descending direction of the cap as the cap is rotated downwardly, a rod shaped nut having a screw engaged with the reverse moving means and moving up and down in a screw direction without rotation, and a display installed in the lower portion of the nut, displaying an opened state of the cap by hanging a part of the cap in the nozzle as the cap is moved downwardly by being pushed by the nut if the cap is opened.

The reverse moving means is a reverse screw rod fixed to the center of the cap, having a reverse screw positioned opposite to the screw of the cap at a pitch larger than that of the cap.

The cap has a hole into which the upper portion of the reverse screw rod is fitted.

The display includes a base having a slit with a protrusion formed at both ends, two facing hanging members having one sides fitted into the slit of the base and hung in the protrusion with splitting outwardly if it is removed from the nozzle by elasticity, and an elastic means formed between the hanging members, providing elasticity.

The base includes passages extended to the center of the nut so that contents in the bottle move.

The passages have a diameter gradually reduced toward the lower portion and are provided with a ball.

The passages include a protrusion at one side to move the ball to the nut at a certain position.

The bottle cap further includes a bearing formed between the display and the nut so as not to rotate the display with rotation of the reverse moving means.

The bearing includes a passage that moves contents in the bottle.

The passage is formed to pass through lower and upper portions and is leaned with respect to a rotary shaft of the cap.

The bottle cap further includes a guide fixed into the nozzle, guiding up and down movement of the nut so as not to avoid rotation of the nut.

The guide includes a plurality of air vents passing through lower and upper portions.

The bottle cap further includes a tension spring formed between the guide and the display to avoid rapid descending movement of the display.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

BEST MODE FOR CARRYING OUT THE INVENTION

Reference will now be made in detail to the preferred embodiments of the present invention, examples of which are illustrated in the accompanying drawings.

Figure 1:
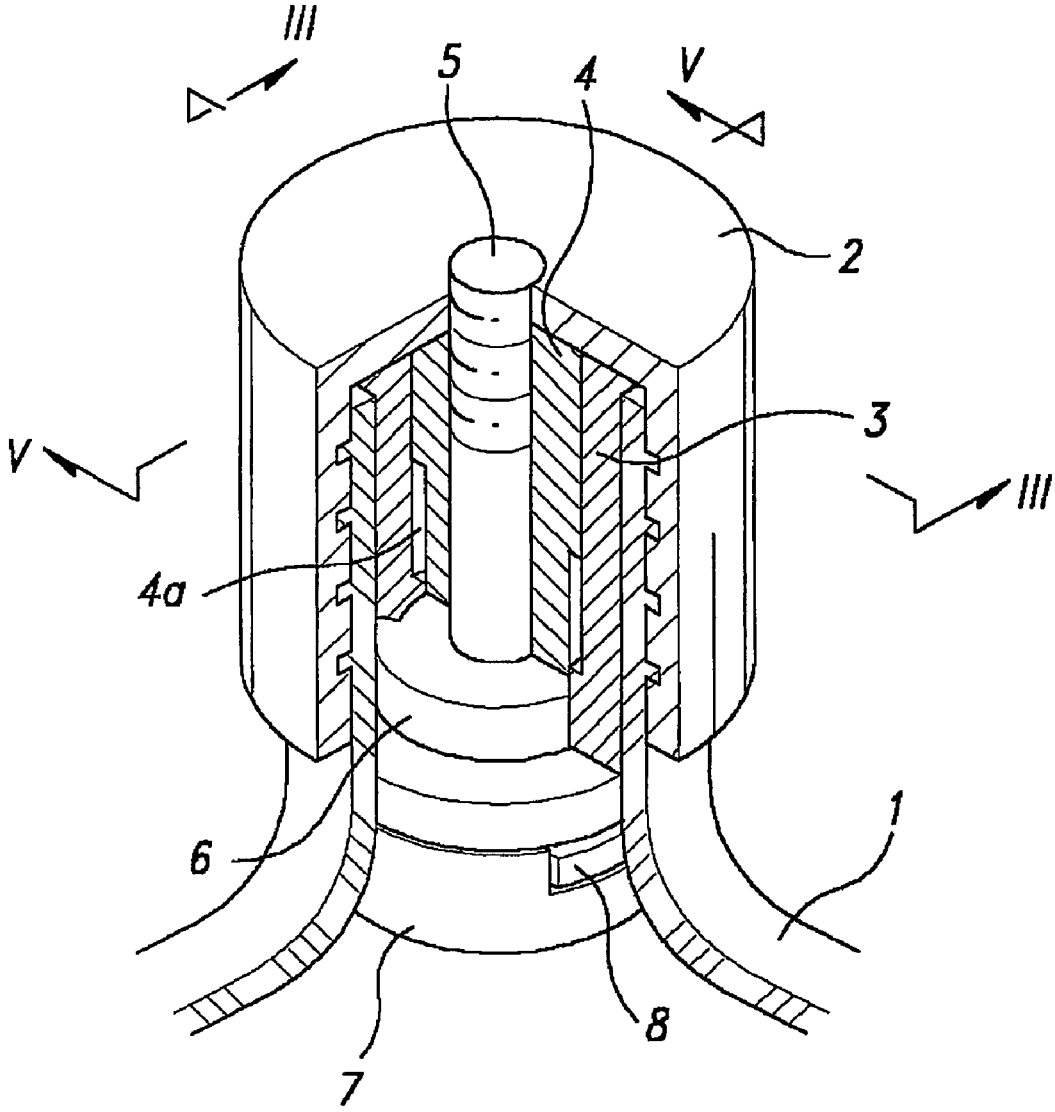
FIG. 1 is a partially cut perspective view illustrating the state that a bottle cap of the present invention is inserted into a bottle.
Figure 2:
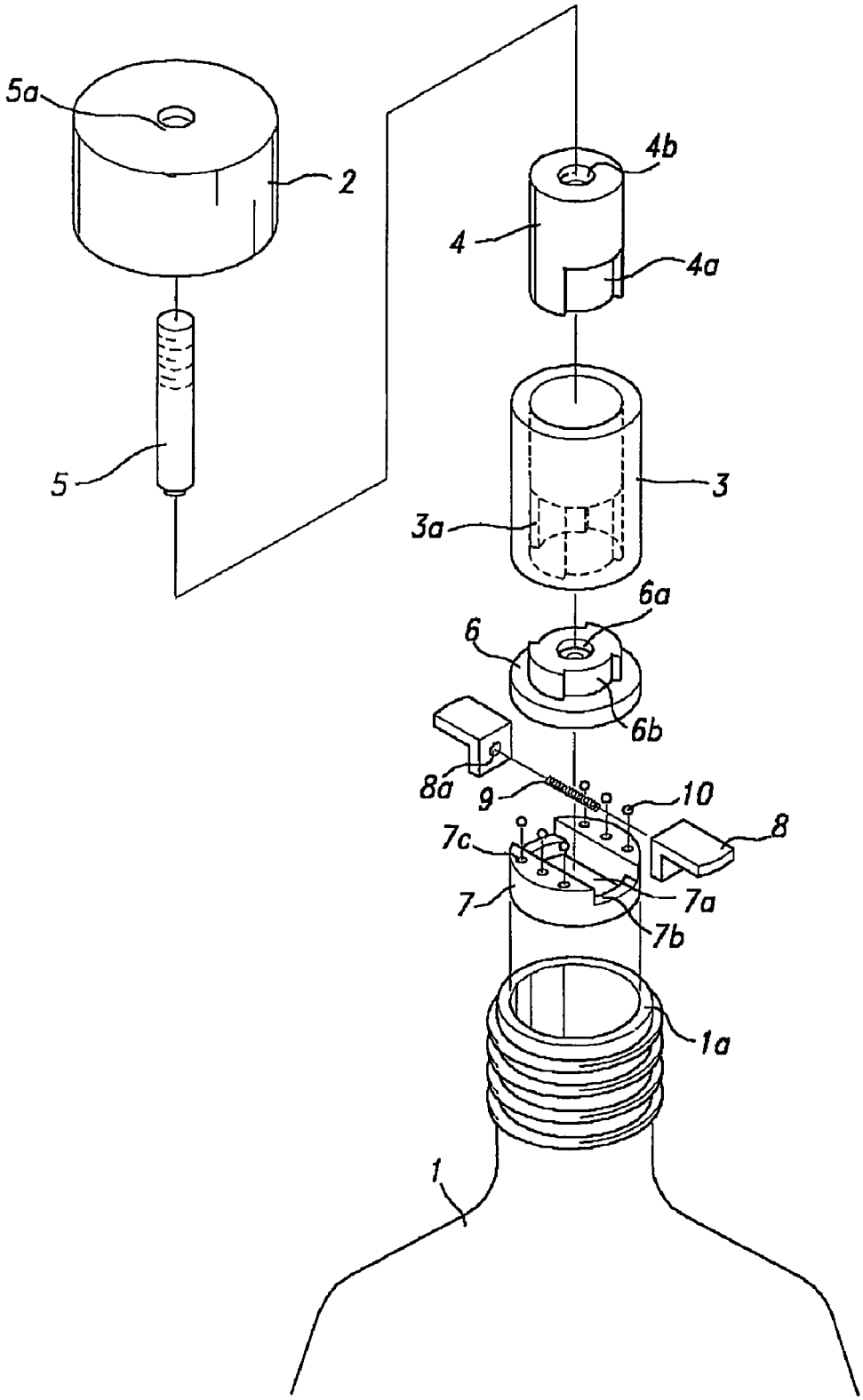
FIG. 2 is an exploded perspective view of a bottle cap according to the present invention.
Figure 3:
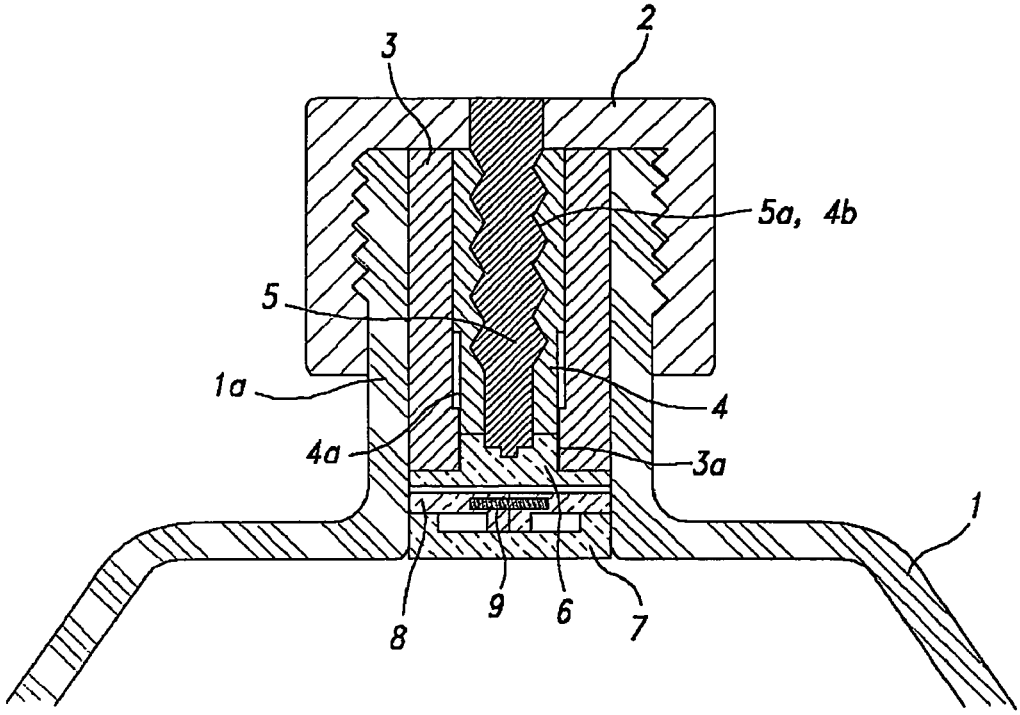
FIG. 3 is a sectional view taken along line III-III of FIG. 1, illustrating that the state that a bottle cap is closed.

FIG. 1 is a partially cut perspective view illustrating the state that a bottle cap of the present invention is inserted into a bottle. Parts inside the bottle cap are shown in FIG. 1. A bottle cap 2 includes a screw formed on its inner surface. The screw is engaged with a screw formed on an outer surface of a nozzle 1*a* of a bottle 1. The bottle cap 2 includes a hole formed at the center and a reverse screw rod 5. The reverse screw rod 5 is fixed to the hole and has a reverse screw 5*a*. The reverse screw 5*a* is positioned in a direction opposite to the screw of the nozzle 1*a* and has a large pitch. The reverse screw rod 5 is threaded into a rod shaped nut 4 and the bottle cap 2 is fastened to the nozzle 1*a* so that the upper portion of the reverse screw rod 5 is inserted into the hole of the bottle cap 2. The reverse screw rod 5 is then fixed to the bottle cap 2 by an adhesive or a heat melting method so that it is rotated with the bottle cap 2. The reverse screw rod 5 is engaged with the nut 4 having a screw 4*b*. The screw 4*b* is guided to move up and down and at the same time is engaged with the reverse screw rod 5. A guide member 3 is formed on an outer surface of the nut 4 and is fixed into the nozzle 1*a*. The guide member 3 guides the nut 4 to be prevented from being rotated. A protrusion 3*a* is formed in the guide member 3 and is protruded inwardly at a certain height from the lower portion of the guide member 3. The protrusion 3*a* is engaged with a groove 4*a* formed on the outer surface of the nut 4. This structure is shown in FIG. 2. The nut 4 moves up and down but is not rotated.

Figure 5:
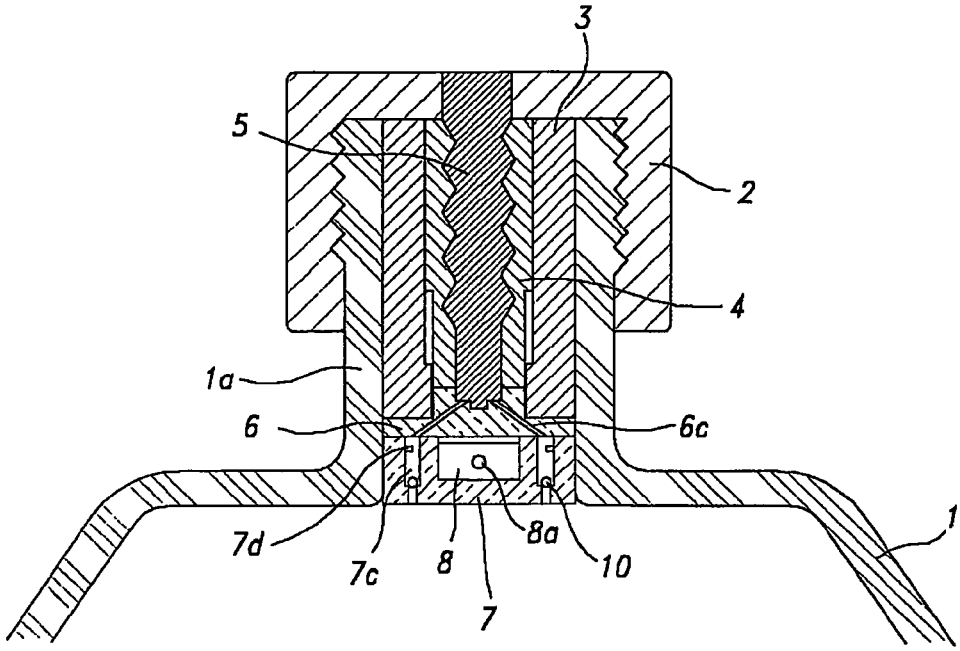
FIG. 5 is a sectional view taken along line V-V of FIG. 1, illustrating that the state that a bottle cap is closed.
Figure 6:
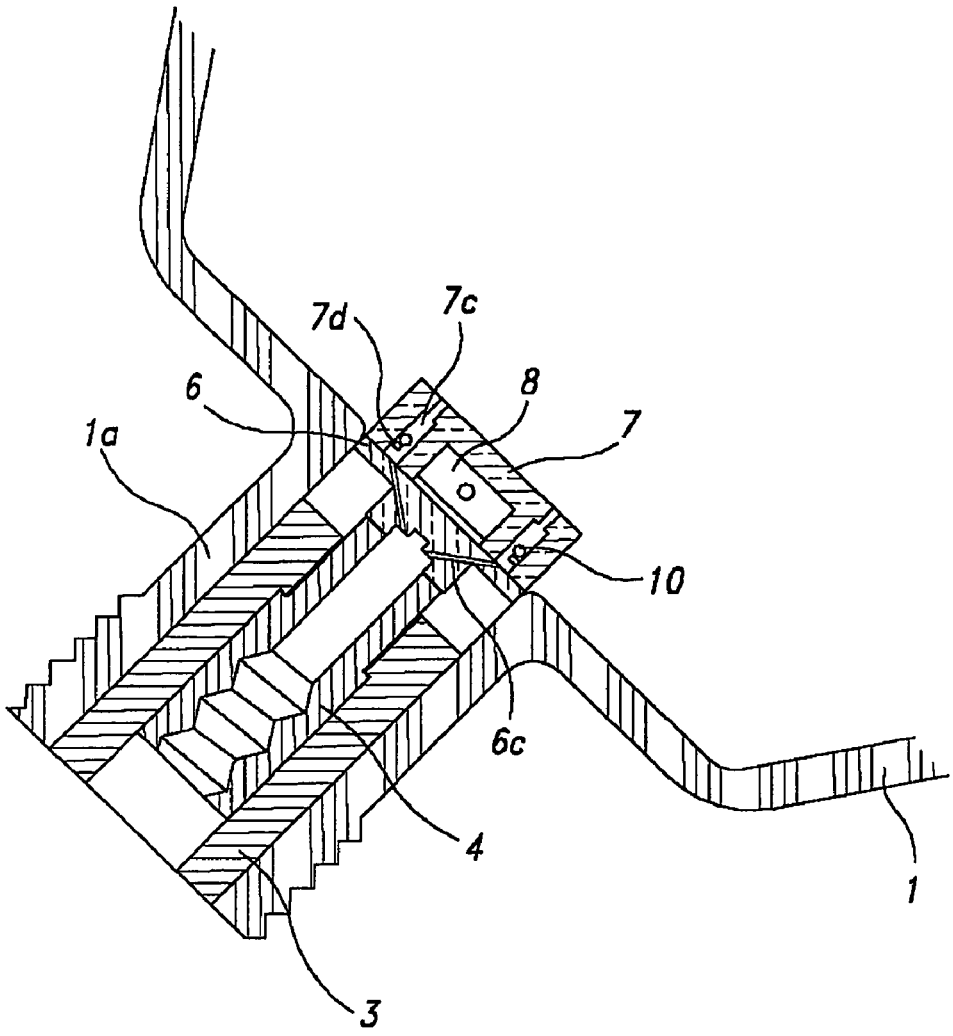
FIG. 6 is a sectional view illustrating the state that contents in a bottle flow out as a bottle cap is opened.

A cap shaped bearing 6 is provided below the lower portion of the nut 4 and the reverse screw rod 5. The bearing 6 includes grooves 6*a* and 6*b*. The groove 6*a* is formed at the center on the bearing 6. The lower portion of the reverse screw rod 5 is inserted into the groove 6*a*. The protrusion 3*a* of the guide member 3 is fitted into the groove 6*b*, so that the bearing is not rotated in the same manner as the nut 4. Therefore, if the nut 4 moves downwardly, the bearing moves downwardly by being pushed by the nut 4 in a state that it is not rotated. As shown in FIGS. 2, 5, and 6, the bearing 6 is provided with a passage 6*c* that moves contents in the bottle. The passage 6*c* is formed toward the groove 6*a* which is in contact with the lower portion of the reverse screw rod 5. A display is provided in the lower portion of the bearing 6 and displays the state that the bottle cap has been opened. The display, as shown in FIGS. 1 and 2, includes a base 7, two facing hanging members 8, and a compressed spring 9. The base 7 has a slit 7*a* with a protrusion 7*b* formed at both ends. The one ends of the hanging members 8 are fitted into the slit 7*a* of the base and are hung in the protrusion 7*b* with being split outwardly if it is removed from the nozzle by elasticity. The compressed spring 9 is formed between the hanging members 8 and provides elasticity. Three passages 7*c* are respectively formed up and down in a symmetrical direction with respect to the center in a portion where the slit 7*a* of the base 7 is not formed, so that contents in the bottle move. The passages 7*c* have a diameter gradually reduced toward the lower portion. A ball 10 is respectively provided in the passages 7*c*. The ball 10 serves to fail to put contents in the bottle through the nozzle 1*a*. A protrusion 7*d* is formed at one side on the passages 7*c* so that the ball 10 is hung therein. The passages 7*c* are respectively positioned to be connected with the passage 6*c* of the bearing 6. A reference numeral 8*a* denotes a groove to which the spring 9 of the hanging members 8 is partially inserted.

The operation of the aforementioned bottle cap according to the present invention will now be described.

If the bottle cap 2 is rotated to open the bottle cap 2, as shown in FIG. 3 to FIG. 6, the bottle cap 2 moves upwardly and the nut 4 engaged with the reverse screw rod 5 moves downwardly without rotation under the guide of the guide member 3. If the nut 4 moves downwardly, the bearing 6 also moves downwardly without rotation under the guide of the guide member 3 and pushes downwardly the display including the hanging members 8 and the base 7.

Figure 4:
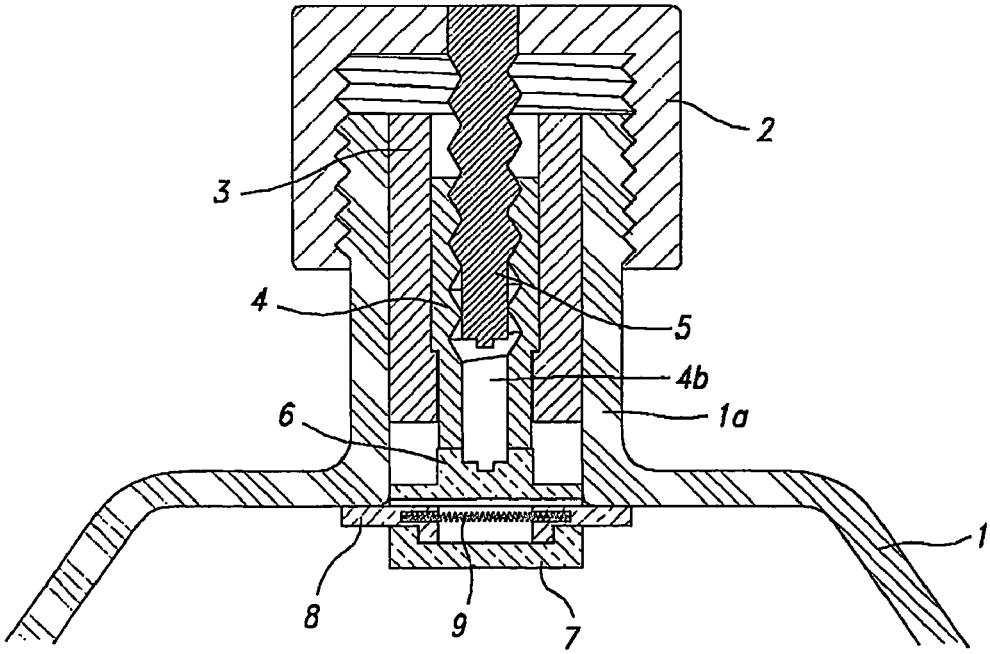
FIG. 4 is a sectional view taken along line III-III of FIG. 1, illustrating that the state that a bottle cap is opened.

If the upper portions of the hanging members 8 pass through the lower portion of the nozzle 1*a*, as shown in FIGS. 4 and 6, the hanging members 8 move outwardly by means of elasticity of the spring 9. As a result, the hanging members 8 are hung in the protrusion 7*b*. In this case, the display cannot be taken out as far as the bottle is not broken.

If the bottle cap 2 is removed, a user cannot put contents in the bottle because the ball 10 cuts off the passages 7*c* of the base 7. In this state, if the user leans the bottle 1, as shown in FIG. 6, contents in the bottle 1 are taken out through the passages 7*c* of the base 7, the passage 6*c* of the bearing 6, and the portion where the reverse screw rod 5 is removed. The contents in the bottle 1 are easily taken out because the ball 10 hung in the protrusion 7*d* does not cut off the passages.

Figure 7:
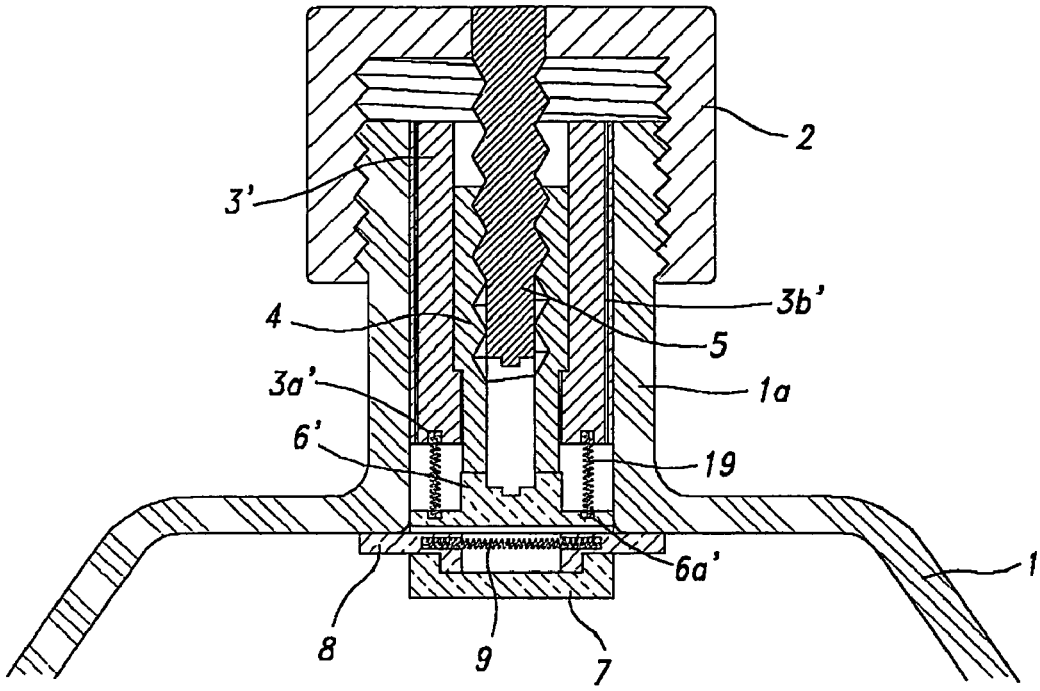
FIG. 7 is a sectional view of a bottle cap according to another embodiment of the present invention.

FIG. 7 is a sectional view of a bottle cap according to another embodiment of the present invention. In this embodiment, a plurality of air vents 3*b*' are formed in the guide member 3' so that the contents in the bottle are easily taken out. A groove 6*a*' is formed in a bearing 6' and at the same time a groove 3*a*' is formed in the lower portion of the guide member 3'. Both ends of a tension spring 19 are fixed to the grooves 3*a*' and 6*a*' so that the bearing 6' and the base 7 are prevented from descending rapidly. Thus, the base 7 is prevented from descending by external impact in a state that the bottle cap 2 is not opened. That is, the base descends only in the range that the nut 4 descends, by elasticity of the tension spring 19.

Figure 8:
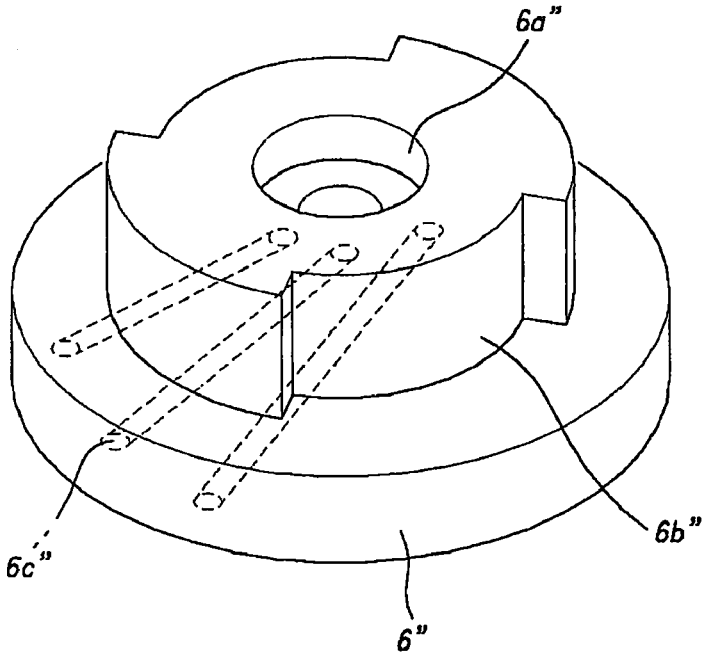
FIG. 8 is a perspective view illustrating an example of a bearing which is an element of a bottle cap according to the present invention.

FIG. 8 is a perspective view illustrating an example of a bearing which is an element of a bottle cap according to the present invention. A passage 6*c*" formed in a bearing 6" is leaned at a certain angle with respect to a rotary shaft of the bottle cap 2. In this case, the contents in the bottle can more easily be taken out. In FIG. 8, the passage 6" at one side is only shown to avoid complexity of the drawing. The passage 6*c*" can be formed in a screw shape, not linear shape, so as to obtain double effect. A reference numeral 6*a*" denotes a groove into which the lower portion of the reverse screw rod 5 is fitted, and a 6*b*" denotes a groove into which the protrusion 3*a* of the guide member 3 is fitted.

INDUSTRIAL APPLICABILITY

As aforementioned, the bottle cap according to the present invention has the following advantages.

Since the hanging members of the display are hung in the lower portion of the nozzle once the bottle cap is opened, it is possible to recognize the fact that the bottle cap has been opened and to fail to insert the contents into the bottle.

While the present invention has been described and illustrated herein with reference to the preferred embodiments thereof, it will be apparent to those skilled in the art that various modifications and variations can be made therein without departing from the spirit and scope of the invention. Thus, it is intended that the present invention covers the modifications and variations of this invention that come within the scope of the appended claims and their equivalents.

What is claimed is:

1. A bottle cap comprising:

a cap having a screw thread which is formed on its inner surface to be engaged with a screw thread which is formed on an outer surface of a nozzle of a bottle;

a reverse moving means having a reverse screw thread connected to the cap and moving in a direction opposite to the cap as the cap is rotated downwardly;

a rod shaped nut having a screw which is engaged with the reverse moving means and moving up and down in a screw direction without rotation; and a display installed at the lower portion of the nut, displaying an opened state of the cap by hanging a part of the cap in the nozzle as the cap is moved downwardly by being pushed by the nut if the cap is opened.

2. The bottle cap according to claim 1, wherein the reverse moving means is a reverse screw rod fixed to the center of the cap, having the reverse screw thread positioned opposite to the screw thread of the cap at a pitch larger than that of the cap.

3. The bottle cap according to claim 2, wherein the cap has a hole into which the upper portion of the reverse screw rod is fitted.

4. The bottle cap according to claim 1, wherein the display includes a base having a slit with a protrusion formed at both ends, two facing hanging members having one sides fitted into the slit of the base and hung in the protrusion with splitting outwardly if it is removed from the nozzle by elasticity, and an elastic means formed between the hanging members, providing elasticity.

5. The bottle cap according to claim 4, wherein the base includes passages extended to the center of the nut so that contents in the bottle move.

6. The bottle cap according to claim 5, wherein the passages have a diameter gradually reduced toward the lower portion and are provided with a ball.

7. The bottle cap according to claim 6, wherein the passages include a protrusion at one side to move the ball to the nut at a certain position.

8. The bottle cap according to claim 1, further comprising a bearing formed between the display and the nut so as not to rotate the display with rotation of the reverse moving means.

9. The bottle cap according to claim 8, wherein the bearing includes a passage that moves contents in the bottle.

10. The bottle cap according to claim 9, wherein the passage is formed to pass through lower and upper portions and is leaned with respect to a rotary shaft of the cap.

11. The bottle cap according to claim 1, further comprising a guide fixed into the nozzle, guiding up and down movement of the nut so as not to avoid rotation of the nut.

12. The bottle cap according to claim 11, wherein the guide includes a plurality of air vents passing through lower and upper portions.

13. The bottle cap according to claim 11, further comprising a tension spring formed between the guide and the display to avoid rapid descending movement of the display.

* * * * *